US005924577A

United States Patent [19]

Gessert

[11] Patent Number: 5,924,577

[45] Date of Patent: Jul. 20, 1999

[54] MODULAR RACK AND STORAGE SYSTEM

[76] Inventor: Roy E. Gessert, 10150 Stern Ave., Cupertino, Calif. 95014

[21] Appl. No.: 08/926,585

[22] Filed: Sep. 4, 1997

[51] Int. Cl.[6] ..... A47F 5/00

[52] U.S. Cl. ..... 211/41.1; 211/41.15; 211/94.02; 211/162; 211/194; 280/79.7

[58] Field of Search ..... 211/41.1, 41.15, 211/94.02, 28, 162, 59.2, 194; 280/79.3, 79.7

[56] References Cited

U.S. PATENT DOCUMENTS

| | | | |
|---|---|---|---|
| 45,648 | 12/1864 | Smith | 211/41.1 X |
| 338,440 | 3/1886 | Raymond | 211/41.15 |
| 3,349,924 | 10/1967 | Maurer et al. | 211/41.1 |
| 3,465,891 | 9/1969 | De Rose | 211/162 X |
| 3,630,387 | 12/1971 | Wehner | 211/194 |
| 3,912,086 | 10/1975 | de Bruyn | 211/162 |
| 4,314,648 | 2/1982 | Spamer | 211/59.2 |
| 5,201,415 | 4/1993 | Metz . | |
| 5,257,794 | 11/1993 | Nakamura | 280/79.3 |
| 5,452,811 | 9/1995 | Taravella et al. | 211/194 X |
| 5,692,625 | 12/1997 | Filipescu et al. | 211/194 X |

*Primary Examiner*—Robert W. Gibson, Jr.
*Attorney, Agent, or Firm*—John J. Leavitt

[57] ABSTRACT

The present invention embodies a novel modular rack and storage system for receiving and supporting planar articles such as stencils, frames, or the like. The rack includes at least one pair of opposed channels, with an upper channel of the pair being located vertically above a lower channel. Each channel has a retaining area facing the opposed channel, thereby forming a slot for receiving the edges of a planar article. The channels are mounted on a spaced pair of rectangular frames, with each frame having an elongate upper horizontal member and an elongate lower horizontal member. The upper and lower horizontal members are each supported on a first end by a first elongate vertical support and on a second end by a second elongate vertical support. The upper channels are mounted to the upper horizontal members and the lower channels are mounted to the lower horizontal members so that the channels hold the spaced frames in an upright position. A plurality of planar articles may be inserted into and retained within the slots formed by the opposed pairs of channels.

24 Claims, 4 Drawing Sheets

MODULAR RACK AND STORAGE SYSTEM

BACKGROUND OF THE INVENTION

1. Field of the Invention

This invention is directed to a modular rack and storage system. Specifically, the invention is directed to a modular rack and storage system for storing planar articles such as screen stencils, silk screen and solder paste stencils, silk screen stencils, and frames for wave solder fixtures.

2. Description of the Prior Art

A preliminary patentability and novelty search has revealed the existence of the following United States Patents:

U.S. Pat. Nos. 4,434,899, 4,867,629, 5,044,505, 5,201,415, 5,593,046

Stencils such as those used in silk screening and surface mounted component electronic circuit boards are typically composed of a screen retained within a flat frame. These frames are generally square or rectangular and typically range in size from 12 by 12 inches to 30 by 30 inches. It is common to have a large number of stencils on hand and readily accessible for use. When these stencils or fixtures are not in use, it is important that they be stored in a convenient, easily accessible manner and remain free of dirt, dust, lint, or other foreign substances which could impair print quality or fixture operation.

Past methods of storage have included wooden racks. The wooden racks are inexpensive, but do not maintain the stencils in an appropriately clean environment due to sawdust and accumulated dirt in slats difficult to clean. Also, the wooden racks are either heavy and difficult to move about between work areas, or are flimsy or short lived, and do not provide proper article support. In addition, the wooden racks are often not aesthetically pleasing in appearance, and it is expensive to make them so.

Other alternatives have included steel panel enclosures such as large metal storage cabinets or welded rack units. While this storage alternative protects the stencils from dirt and dust, these enclosures are very heavy, expensive to ship and transport and not easily movable to and from a work area. Furthermore, the metal cabinets do not provide the ability to expand storage space gradually as required, but, instead, an entire additional enclosure must be purchased, resulting in both wasted money and space. Also, insertion and removal of a stencil or fixture tends to abrade or damage the stencil or wear the paint and surface of the storage unit.

Consequently, it is apparent that a need exists for a modular rack and storage system for storing stencils, frames, and similar large flat objects in an orderly manner without damage to the storage unit or article to be stored. The system should be convenient to use, easily cleaned, able to be mounted far mobility when desired, and expandable in capacity to meet changing storage requirements. The present invention overcomes the shortcomings associated with the prior art storage structures and methods, and provides a substantial advance in the art.

SUMMARY OF THE INVENTION

The present invention embodies a novel rack unit for supporting and storing planar articles such as stencils, frames, and the like. The rack unit includes a plurality of elongate channels mounted in opposed pairs, with each opposed pair of channels serving as upper and lower guides and supports for receiving and retaining a planar article. The channels are supported by first and second rectangular frames, and the channels serve as structural cross-supports for retaining the frames in an upright position. Each rectangular frame member includes an upper horizontal member, a lower horizontal member, and a pair of vertical supports attached to the ends of the horizontal members. The upper and lower horizontal support members include a fastening means for attaching the channels to the horizontal support members. The channels also include polymer inserts which act as liners to protect the edges of the planar articles and the channels from nicks, burrs, and wear during insertion of the article into the rack unit.

A plurality of modular rack units of the same or different sizes may be combined to form a larger rack assembly. A first rack unit may be stacked on top of a second rack unit by inserting a crimped insertion portion of the vertical supports of the first rack unit into openings in the vertical supports of the second rack unit. Furthermore, feet may be fitted to the lower portion of the vertical supports for enabling a rack unit to be bolted to a floor or a movable cart. Additional advantages of the present invention will be apparent from the following detailed description of the preferred embodiment.

BRIEF DESCRIPTION OF THE DRAWINGS

FIG. 3 is a perspective view illustrating a first rack unit of the present invention stacked on a second rack unit.

DESCRIPTION OF THE PREFERRED EMBODIMENT

Figure 1:
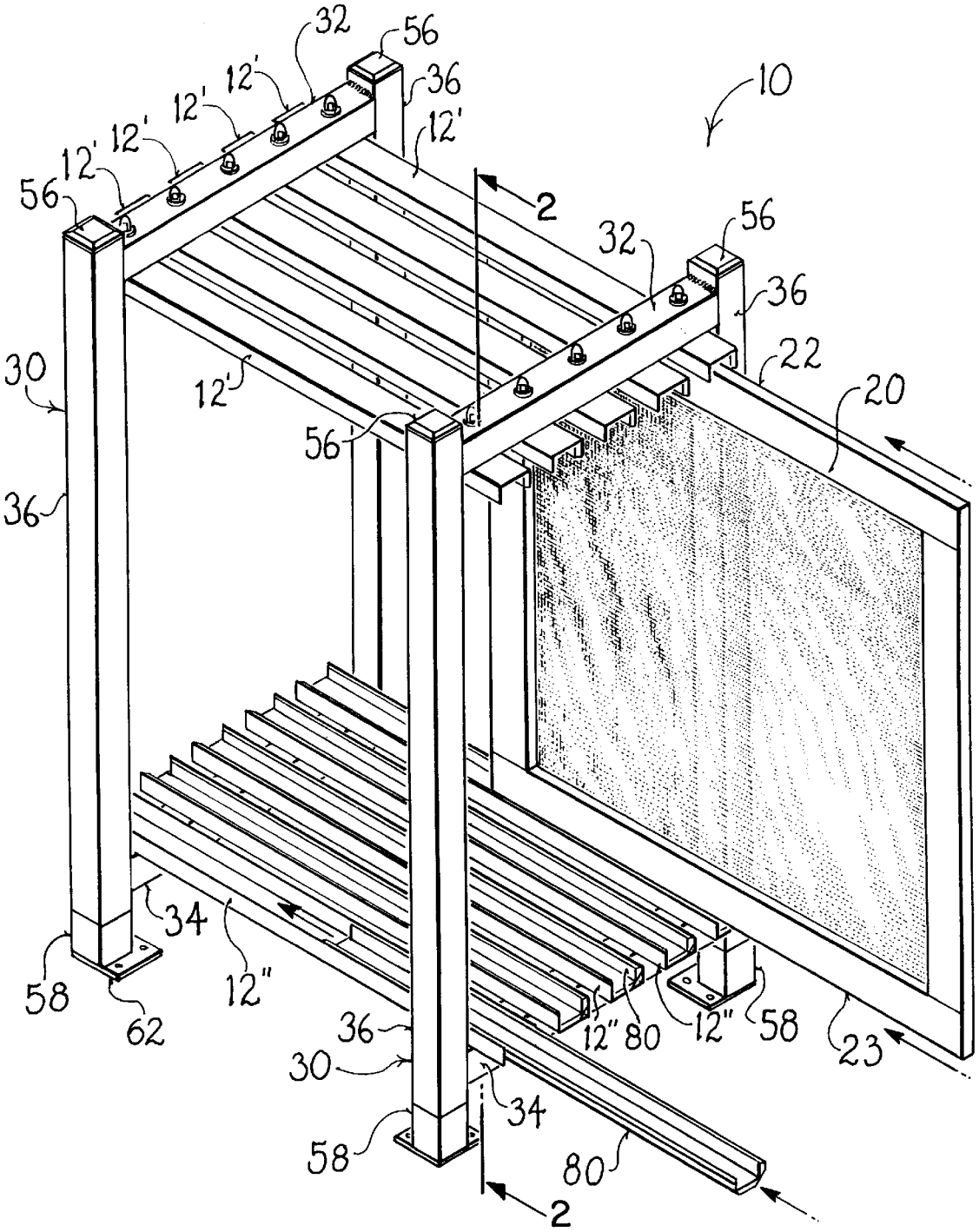
FIG. 1 is a perspective view of a rack unit of the present invention, illustrating the partial insertion of a planar article therein.
Figures 2, 4:
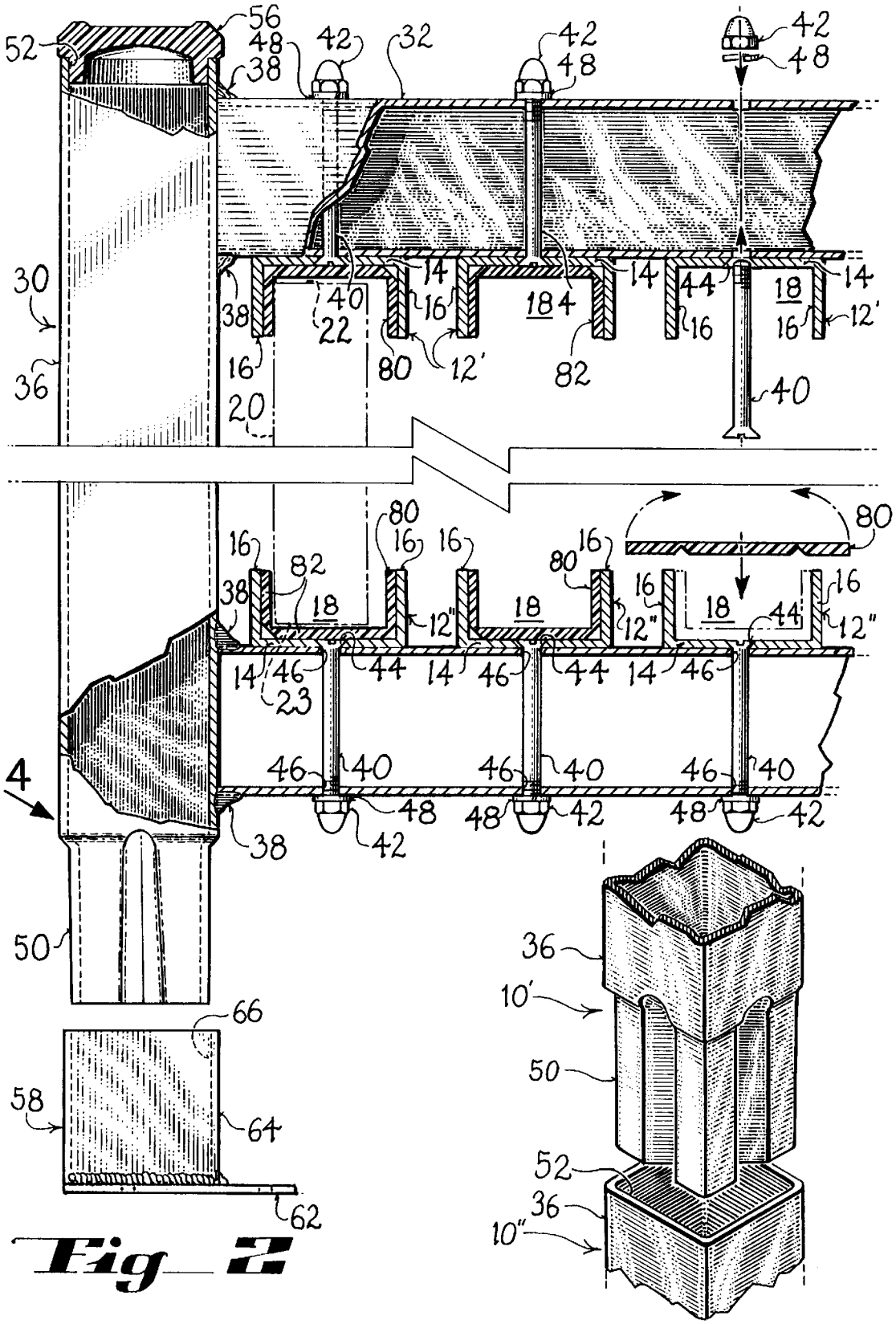
FIG. 2 is an enlarged fragmentary vertical cross-sectional view taken along line 2—2 of FIG. 1, portions of the structure being shown in elevation for clarity.
FIG. 4 is a perspective view of the crimped portion of a vertical support shown in relation to the associated socket-like opening of a lower vertical support member.

The invention is directed to a rack and storage system for vertically receiving and retaining one or more planar articles such as a stencil for use in silk screening or the like. As illustrated in FIG. 1 a rack unit 10 includes a plurality of elongate parallel channels 12. As illustrated in FIG. 2, each channel 12 includes a center wall 14 and two side walls 16 which extend perpendicularly from center wall 14 so that an open channel retaining area 18 is created between side walls 16. Channels 12 are configured as parallel, vertically opposed pairs so that retaining area 18 of an upper channel 12' is facing retaining area 18 of a lower channel 12" for each opposed pair. Thus, each opposed pair of upper and lower channels 12', 12" creates a vertical storage location or slot for a planar article 20 (FIGS. 1 and 2) whereby the upper and lower edges 22, 23 of planar article 20 fit within retaining area 18 (FIG. 2), and are prevented from excessive lateral movement by side walls 16 and from vertical movement by center walls 14 of the channels 12', 12" of the opposed pair. Channels 12 are preferably made of structural steel, but may also be made of aluminum, polymer, fiberglass composite, or other suitable materials.

Channels 12 are attached perpendicularly to a spaced pair of vertically disposed rectangular frames 30. One frame 30 is attached near each end of each channel 12, and frames 30 are preferably generally identical and arranged parallel to each other. Each frame 30 includes an elongate upper horizontal member 32 for attachment near one end of each upper channel 12', and an elongate lower horizontal member 34 for attachment near one end of each lower channel 12". Upper horizontal member 32 and lower horizontal member 34 are supported on each end by a perpendicularly disposed elongate vertical support 36. Thus, it may be seen that the two spaced and parallel vertical supports 36 and the upper and lower horizontal members 32, 34 are assembled to form a unitary and rigid rectangular frame 30.

Upper horizontal member 32, lower horizontal member 34, and vertical supports 36 are preferably constructed from square steel tuning, although other materials such as aluminum, polymers, and composites may also be used. In addition, while square tubing is preferred, other structural shapes such as angles, round tubing, or the like could be substituted, as will be apparent to one skilled in the art. Upper horizontal member 32 and lower horizontal member 34 may be welded to vertical supports 36 by fillet welds 38 as illustrated in FIG. 2, or alternative known methods of attachment may be used.

In assembling a rack unit 10, two frames 30 are positioned in a spaced relationship to each other approximating the length of channels 12. At Least one opposed pair of channels 12 are attached to both frames 30 using screws 40 and cap nuts 42. Screws 40 pass through countersunk holes 44 in center wall 14 near the end of each channel 12, or may be spot welded or otherwise attached to center wall 14. Screws 40 also are inserted through screw holes 46 in upper horizontal member 32 and lower horizontal member 34. A washer 48 is placed under each cap nut 42 to prevent unintentional loosening of cap nuts 42. When at least one opposed pair of channels 12 has been attached to a pair of frames 30, it may be seen that channels 12 will hold frames 30 in an upright position with no additional cross-support members, and will be able to support at least one planar article in the slot formed by the opposed upper and lower channels 12', 12".

By installing a plurality of parallel opposed channel pairs 12', 12" on rack unit 10, a plurality of parallel slots are created for receiving and storing a plurality of planar articles 20. As additional opposed channel pairs are installed on frames 30, rack unit 10 will become more rigid and have additional slots able to support additional planar articles 20. Accordingly, the channel pairs 12', 12" which act as slots for supporting and retaining planar articles 20 also serve a structural purpose as cross-supporting members for holding and supporting frames 30 through proper location of screw holes 46 and serve to properly align upper and lower channels 12', 12" in the correct location to function as opposed pairs. Consequently, no additional supporting side members or cross members are required for constructing a rack unit 10. Because channels 12 simultaneously act as both slots for receiving planar articles, and as cross support members for retaining rack 10 in an assembled and upright position, rack 10 is lighter and requires less raw materials than would otherwise be the case if additional cross-supports were used between spaced frames 30. The channels 12' 12", may also be formed integrally as a single unit to provide a plurality of walls 14 and 16, providing multiple opposing slots 12' or 12" as opposing channels and attached to the horizontal members 32 and 34 by as few as four screws 40, cap nuts 42 and washers 48.

Once a rack unit 10 is assembled, it forms a generally open framed box-like structure. A single rack unit 10 may be used to store a plurality of planar articles 20, and may be used in conjunction with additional rack units 10. Advantageously, a first rack unit 10' may be stacked on a second rack unit 10" in a modular manner, as illustrated in FIG. 3. To facilitate stacking, each vertical support 36 includes a crimped or reduced-size insertion portion 50 on a first end thereof. This reduced-size insertion portion may be inserted in a telescoping manner into an opening 52 formed on the second end of a second vertical support 36, as illustrated in FIG. 4. Friction at the interfaces between crimped insertion portion 50 and opening 52 is generally sufficient to hold a first rack 10' firmly in place on a second rack 10". However, set screws or other fastening means (not shown) may be included for added security. In addition, while crimped insertion portion 50 is shown as being on the bottom end and opening 52 on the top end of vertical supports 36, it will be apparent that the cooperative arrangement of crimped insertion portions 50 and openings 52 may be reversed without departing from the spirit of the invention.

Figure 5:
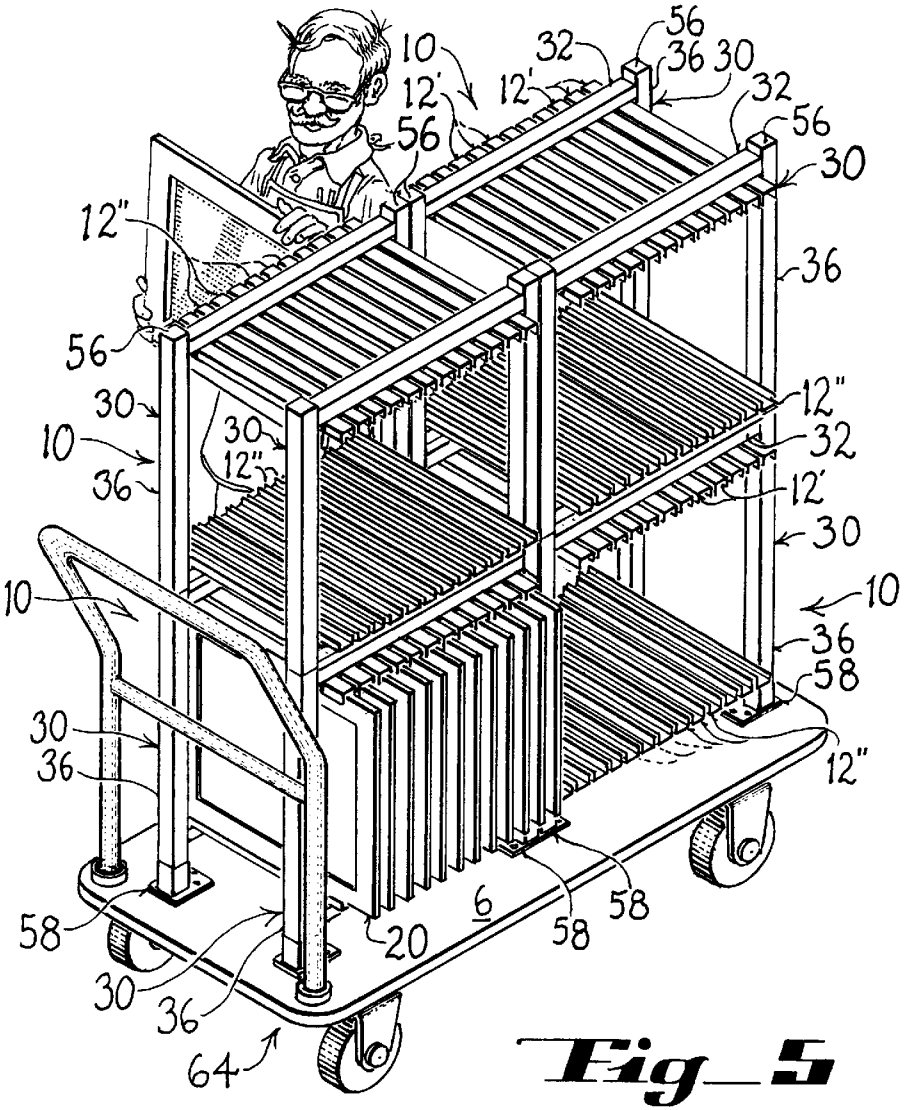
FIG. 5 is a perspective view illustrating a plurality of stacked rack units of the present invention mounted on a movable cart.

To cover opening 52 in vertical support 36 when opening 52 is not being used to support a second rack unit 10, a cap 56 is provided for insertion into opening 52 as shown best in FIG. 2. Cap 56 is vinyl, PVC, or other polymer material, and is pressed into place in opening 52. In addition, individual feet 58 are provided for attachment to the bottom ends of vertical supports 36. Feet 58 are useful for bolting a rack unit 10 to a horizontal surface 60, such as a floor or pallet, as shown in FIG. 3. Feet 58 include a base plate 62 which may be fastened to horizontal surface 60 by any suitable means. A square tube 64 is mounted perpendicularly on base plate 62 by welding or the like, as illustrated in FIG. 2. Square tube 64 has an upper opening 66 for receiving crimped insertion portion 50 of vertical support 36 in a telescoping manner similar to that described above with respect to vertical support opening 52. In addition, as illustrated in FIG. 5, feet 58 may be used to mount a rack unit 10 to a horizontal surface 63 on a wheeled cart 64, so that one or more rack units 10 may be easily moved from one work area to another. Note that base plate 62 is offset fully to one vertical planar surface of square tube 64, thus enabling fully contiguous positioning of rack units 10 side-by-side when assembling two or more rack units to form a multitude of rack units 10.

Rack units 10 may be constructed in various sizes for receiving and storing various sizes of planar articles. For optimum performance of the present invention, the distance between the center wall 14 of upper channel 12' and the center wall 14 of lower channel 12" should be slightly greater than the height of the planar article 20. Accordingly, planar article 20 should be of sufficient height so that the upper edge 22 of planar article 20 is located within retaining area 18 of upper channel 12'. Or, in other words, when planar article 20 is placed in the slot formed by the opposed pair of channels 12', 12", the lower edge 23 of planar article 20 should rest on center wall 14 of lower channel 12", while the upper edge 22 of planar article 20 should be spaced slightly from center wall 14 and located between side walls 16 of upper channel 12'.

Figure 6:
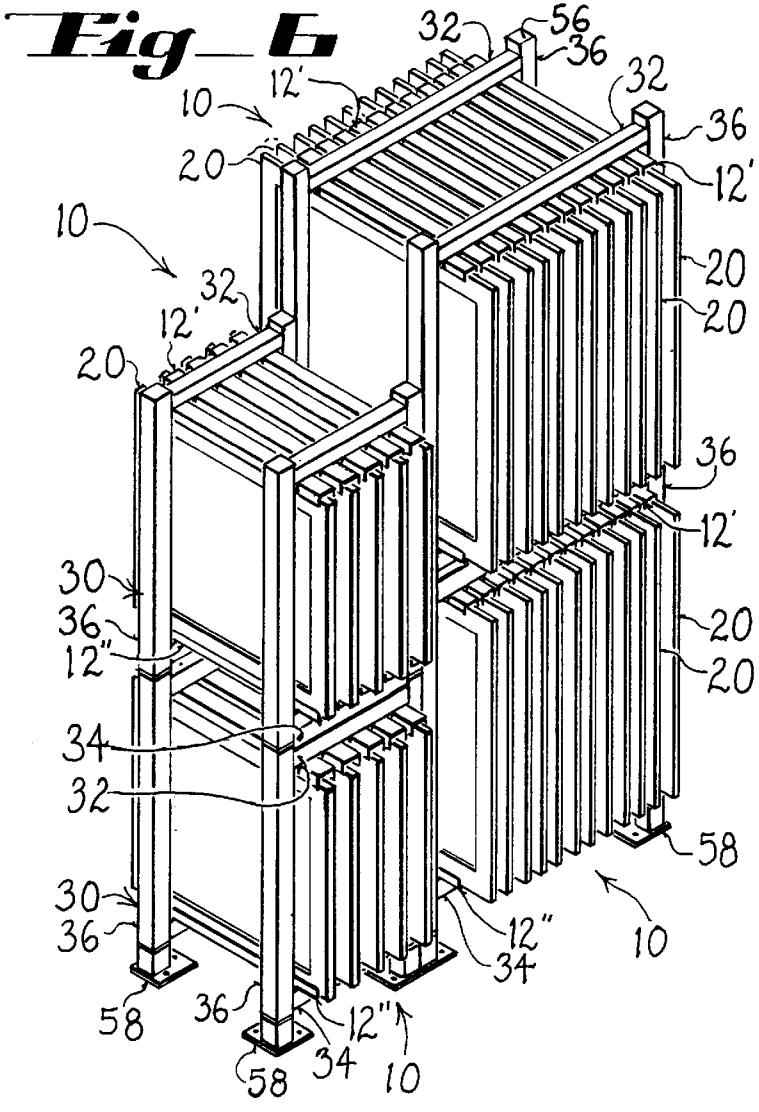
FIG. 6 is a perspective view illustrating a plurality of stacked rack units in an alternate configuration.

In addition, for stacking one rack unit 10' on top of another rack unit 10", it is important that frames 30 be laterally spaced apart the same distance, and that upper and lower horizontal members 32, 34 be the same length for both rack units 10', 10". However, the height of vertical supports 36 may be different between rack unit 10' and rack unit 10", as shown in FIG. 3. (Height refers to the vertical distance between upper horizontal member 32 and lower horizontal member 34.) Accordingly, rack units 10 which accommodate different sizes of planar articles 20 may be stacked one upon the other. In addition, several rack units 10 of differing sizes may originally be acquired by a consumer. Then, additional rack units 10 may be acquired and stacked upon existing rack units 10 as capacity requirements increase, as illustrated in FIG. 6.

Figure 7:
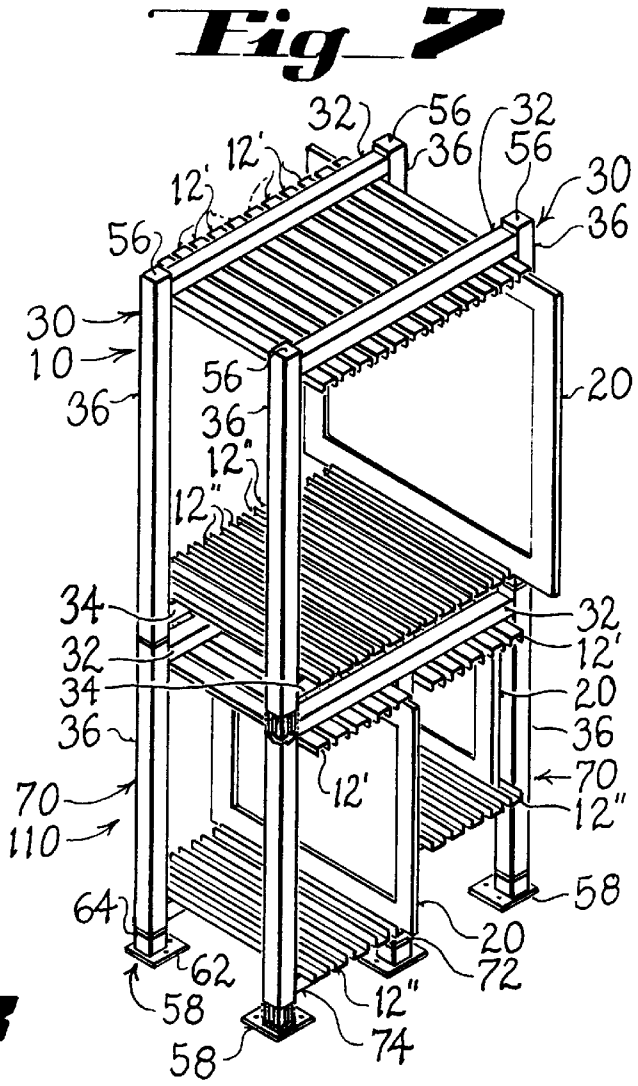
FIG. 7 is a perspective view illustrating an alternative embodiment of a rack unit.
Figure 8:
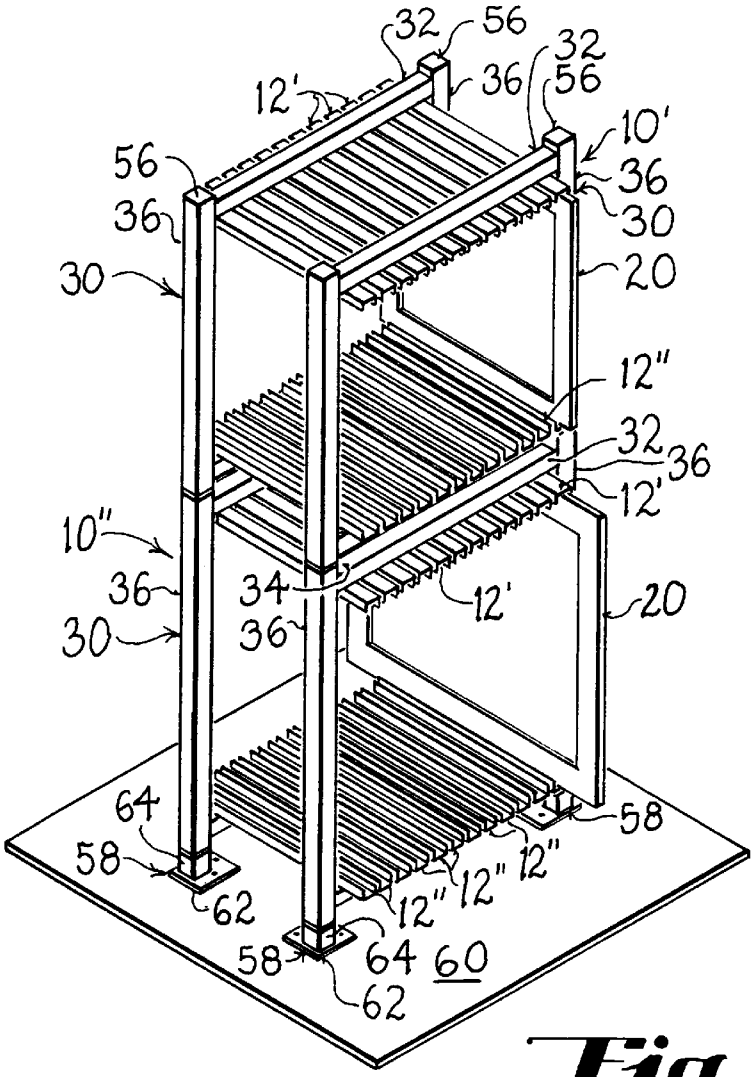

Alternatively, as illustrated in FIG. 7, a rack unit 110 may be provided which enables storage of a plurality of sizes of planar articles 20 on a single rack unit. Rack unit 110 includes a pair of generally rectangular frames 70 which are similar to frames 30, but which include an additional vertical support 72, and vertically offset lower horizontal members 74. By providing vertically offset lower horizontal members 74 rather than a single lower horizontal member 34, it may be seen that planar articles of differing heights may be accommodated on a single rack unit 110.

To provide further protection to planar articles 20 and channels 12', 12" against nicks, scratches, wear, or burrs, elongate polymer liners 80 are inserted into channels 12. Liners 80 are preferably of polyvinyl chloride, vinyl, polyethylene, polypropylene or other suitable materials, and may be extruded in a channel shape to snugly fit the channels 12' and 12", or constructed from a flat strip of polymeric material provided with a "live" hinge as illustrated in FIG. 2 to enable the side walls 16 to be folded perpendicular to center wall 14. Liners 80 include beveled edges 82 on each end to enable planar article 20 to be inserted more easily. Liners 80 may be held in place in channels 12 by frictional engagement with side walls 16 or, alternatively, an adhesive may be used for retaining liners 80 in position on wall 14. The open frame design of the rack unit 10 allows liners 80 in channel retaining area 18 to be more easily cleaned, and liners 80 may be replaced if they are severely contaminated or damaged.

Although preferred embodiments have been described herein, it will be recognized that a variety of changes and modifications may be made without departing from the spirit of the subject invention, the scope of which is set forth in the following claims.

I claim:

1. A rack for receiving and supporting planar articles, said rack comprising:

a) at least one pair of opposed channels, with an upper channel of said pair being located vertically above a lower channel of said pair, each said channel having a retaining area facing the opposed said channel for receiving an edge of a planar article; and b) a spaced pair of generally rectangular frames, each said frame having an elongate upper horizontal member and an elongate lower horizontal member, with said upper and lower horizontal members each being supported on a first end by a first elongate vertical support and on a second end by a second elongate vertical support, said upper channel being mounted to said upper horizontal members and said lower channel being mounted to said lower horizontal members, whereby said channels hold said spaced frames in an upright position, and further whereby the planar article may be inserted into and retained between said opposed pair of channels.

2. The rack of claim 1 in which a plurality of said pairs of opposed channels are arranged parallel to each other, each said pair having an upper channel located vertically above a lower channel, with each said upper channel being mounted to said upper horizontal members, and each said lower channel being mounted to said lower horizontal members.

3. The rack of claim 2 in which each of said vertical supports includes an opening on a first end and an insertion portion on a second end, whereby an insertion portion of a vertical support on a first rack may be inserted into said opening on a vertical support on a second rack for stacking one of said first or second racks on the other of said first or second racks.

4. A rack for receiving and supporting planar articles, said rack comprising:

a) at least one pair of opposed channels, with an upper channel of said pair being located vertically above a lower channel of said pair, each said channel having a retaining area facing the opposed said channel for receiving an edge of a planar article;

b) a spaced pair of generally rectangular frames, each said frame having an elongate upper horizontal member and an elongate lower horizontal member, with said upper and lower horizontal members each being supported on a first end by a first elongate vertical support and on a second end by a second elongate vertical support, said upper channel being mounted to said upper horizontal members and said lower channel being mounted to said lower horizontal members, whereby said channels hold said spaced frames in an upright position, and further whereby the planar article may be inserted into and retained between said opposed pair of channels, and c) feet connectable to said vertical supports, said feet having a base plate for attaching said rack to a horizontal surface.

5. The rack of claim 4 in which said horizontal surface is on a wheeled cart, and said rack is mounted thereon.

6. A rack and storage system for receiving and storing planar articles, said rack and storage system comprising:

a) a plurality of parallel opposed pairs of elongate channels, with each said pair of channels having an upper channel and a lower channel, each said channel having a retaining area facing the other opposed channel for receiving therein an edge of a planar article; and b) first and second vertically disposed frames in a parallel spaced relationship to each other, each said frame being generally rectangular and having an elongate upper horizontal member and an elongate lower horizontal member, with said upper horizontal member and said lower horizontal member being supported by two elongate vertical supports, wherein said plurality of channels are attached perpendicularly to said frames for supporting said frames in said vertically disposed manner.

7. The rack and storage system of claim 6 in which each of said vertical supports includes an opening on a first end and an insertion portion on a second end, whereby an insertion portion of a vertical support on a first rack may be inserted into said opening on a vertical support on a second rack for stacking one of said first or second racks on the other of said first or second racks.

8. A rack and storage system for receiving and storing planar articles, said rack and storage system comprising:

a) a plurality of parallel opposed pairs of elongate channels, with each said pair of channels having an upper channel and a lower channel, each said channel having a retaining area facing the other opposed channel for receiving therein an edge of a planar article;

b) first and second vertically disposed frames in a parallel spaced relationship to each other, each said frame being generally rectangular and having an elongate upper horizontal member and an elongate lower horizontal member, with said upper horizontal member and said lower horizontal member being supported by two elongate vertical supports, wherein said plurality of channels are attached perpendicularly to said frames for supporting said frames in said vertically disposed manner; and c) feet connectable to said vertical supports, said feet having a base plate for attaching said rack to a horizontal surface.

9. The rack and storage system of claim 8 in which said horizontal surface is on a wheeled cart.

10. A rack for receiving and retaining planar articles in a generally vertical disposition, said rack comprising:

a) first and second frames, each said frame being generally rectangular, and having upper and lower horizontal members and first and second vertical supports;

b) a plurality of upper channels in generally parallel relationship to each other;

c) a plurality of lower channels in generally parallel relationship to each other and to said upper channels;

d) wherein said first frame is spaced generally parallel to said second frame, and said upper channels are attached to said upper horizontal members and said lower channels are attached to said lower horizontal members in such manner that each one of said upper channels is in alignment with a discrete one of said lower channels for forming a plurality of opposed pairs of channels, whereby each said opposed pair of channels forms a slot for receiving a planar article and functions to retain said first and second frames in an upright parallel relationship.

11. The rack of claim 10 in which each of said vertical supports includes an opening on a first end and an insertion portion on a second end, whereby said insertion portion of a vertical support on a first rack may be inserted into said opening on a vertical support on a second rack for stacking one of said first or second racks on the other of said first or second racks.

12. A rack for receiving and retaining planar articles in a generally vertical disposition, said rack comprising:

a) first and second frames, each said frame being generally rectangular, and having upper and lower horizontal members and first and second vertical supports;

b) a plurality of upper channels in generally parallel relationship to each other;

c) a plurality of lower channels in generally parallel relationship to each other and to said upper channels;

d) wherein said first frame is spaced generally parallel to said second frame, and said upper channels are attached to said upper horizontal members and said lower channels are attached to said lower horizontal members in such manner that each one of said upper channels is in alignment with a discrete one of said lower channels for forming a plurality of opposed pairs of channels, whereby each said opposed pair of channels forms a slot for receiving a planar article; and e) feet connectable to said vertical supports, said feet having a base plate for attaching said rack to a horizontal surface.

13. The rack of claim 12 in which said horizontal surface is on a wheeled cart, and said rack is mounted thereon.

14. The rack of claim 1 in which the spacing between said pair of rectangular frames, including said elongate upper and lower horizontal members and said elongate vertical support members is such that accessibility to said opposed channels is provided to facilitate cleaning thereof.

15. The rack of claim 1 in which said opposed channels are formed from abrasion resistant material whereby the production of contaminating particulate material from said channels and said planar articles is eliminated during insertion or removal of said planar articles.

16. The rack and storage system of claim 8 in which said feet include a square tube having one open end mounted on said base plate so that the opposed open end is spaced above said base plate, and two adjacent perpendicular sides of said square tube are coincident with two adjacent perpendicular edges of said base plate whereby said feet may be selectively connected to said vertically disposed frames to enable contiguous arrangement of a plurality of rack and storage systems.

17. The rack of claim 12 in which said first and second vertical supports of said first and second frames are formed from tubular material, and said feet connectable to said vertical tubular supports include tubular members mounted on said base plates and into which associated ends of said tubular supports may be snugly inserted.

18. A rack for receiving and supporting planar articles, said rack comprising:

a) at least one pair of opposed channels, with an upper channel of said pair being located vertically above a lower channel of said pair, each said channel having a retaining area facing the opposed said channel for receiving an edge of a planar article;

b) a spaced pair of generally rectangular frames, each said frame having an elongate upper horizontal member and an elongate lower horizontal member, with said upper and lower horizontal members each being supported on a first end by a first elongate vertical support and on a second end by a second elongate vertical support, said upper channel being mounted to said upper horizontal members and said lower channel being mounted to said lower horizontal members, whereby said channels hold said spaced frames in an upright position, and further whereby the planar article may be inserted into and retained between said opposed pair of channels;

c) a plurality of said pairs of opposed channels are arranged parallel to each other, each said pair having an upper channel located vertically above a lower channel, with each said upper channel being mounted to said upper horizontal members, and each said lower channel being mounted to said lower horizontal members;

d) each of said vertical supports includes an opening on a first end and an insertion portion on a second end, whereby an insertion portion of a vertical support on a first rack may be inserted into said opening on a vertical support on a second rack for stacking one of said first or second racks on the other of said first or second racks; and e) wherein said first rack is of a different height than said second rack.

19. A rack for receiving and supporting planar articles, said rack comprising:

a) at least one pair of opposed channels, with an upper channel of said pair being located vertically above a lower channel of said pair, each said channel having a retaining area facing the opposed said channel for receiving an edge of a planar article;

b) a spaced pair of generally rectangular frames, each said frame having an elongate upper horizontal member and an elongate lower horizontal member, with said upper and lower horizontal members each being supported on a first end by a first elongate vertical support and on a second end by a second elongate vertical support, said upper channel being mounted to said upper horizontal members and said lower channel being mounted to said lower horizontal members, whereby said channels hold said spaced frames in an upright position, and further whereby the planar article may be inserted into and retained between said opposed pair of channels; and c) elongate polymer liners for lining said retaining area of said channels, whereby said liners protect the edges of the planar article and the channels.

20. A rack for receiving and supporting planar articles, said rack comprising:

a) at least one pair of opposed channels, with an upper channel of said pair being located vertically above a lower channel of said pair, each said channel having a retaining area facing the opposed said channel for receiving an edge of a planar article;

b) a spaced pair of generally rectangular frames, each said frame having an elongate upper horizontal member and an elongate lower horizontal member, with said upper and lower horizontal members each being supported on a first end by a first elongate vertical support and on a second end by a second elongate vertical support, said upper channel being mounted to said upper horizontal members and said lower channel being mounted to said lower horizontal members, whereby said channels hold said spaced frames in an upright position, and further whereby the planar article may be inserted into and retained between said opposed pair of channels; and c) wherein each of said frames includes a third elongate vertical support located centrally of said first and second vertical supports; and further wherein said lower horizontal member comprises two vertically offset lower horizontal members located one on each side of said third vertical support.

21. A rack and storage system for receiving and storing planar articles, said rack and storage system comprising:

a) a plurality of parallel opposed pairs of elongate channels, with each said pair of channels having an upper channel and a lower channel, each said channel having a retaining area facing the other opposed channel for receiving therein an edge of a planar article;

b) first and second vertically disposed frames in a parallel spaced relationship to each other, each said frame being generally rectangular and having an elongate upper horizontal member and an elongate lower horizontal member, with said upper horizontal member and said lower horizontal member being supported by two elongate vertical supports, wherein said plurality of channels are attached perpendicularly to said frames for supporting said frames in said vertically disposed manner; and c) each of said vertical supports includes an opening on a first end and an insertion portion on a second end, whereby an insertion portion of a vertical support on a first rack may be inserted into said opening on a vertical support on a second rack for stacking one of said first or second racks on the other of said first or second racks; and d) said first rack is of a different height than said second rack.

22. A rack and storage system for receiving and storing planar articles, said rack and storage system comprising:

a) a plurality of parallel opposed pairs of elongate channels, with each said pair of channels having an upper channel and a lower channel, each said channel having a retaining area facing the other opposed channel for receiving therein an edge of a planar article;

b) first and second vertically disposed frames in a parallel spaced relationship to each other, each said frame being generally rectangular and having an elongate upper horizontal member and an elongate lower horizontal member, with said upper horizontal member and said lower horizontal member being supported by two elongate vertical supports, wherein said plurality of channels are attached perpendicularly to said frames for supporting said frames in said vertically disposed manner; and c) elongate polymer liners for lining said retaining area of said channels, whereby said liners protect the edges of the planar article and the channels.

23. A rack for receiving and retaining planar articles in a generally vertical disposition, said rack comprising:

a) first and second frames, each said frame being generally rectangular, and having upper and lower horizontal members and first and second vertical supports;

b) a plurality of upper channels in generally parallel relationship to each other;

c) a plurality of lower channels in generally parallel relationship to each other and to said upper channels;

d) wherein said first frame is spaced generally parallel to said second frame, and said upper channels are attached to said upper horizontal members and said lower channels are attached to said lower horizontal members in such manner that each one of said upper channels is in alignment with a discrete one of said lower channels for forming a plurality of opposed pairs of channels, whereby each said opposed pair of channels forms a slot for receiving a planar article; and e) elongate polymer liners for lining said channels, whereby said liners protect the edges of the planar article and the channels.

24. A rack for receiving and retaining planar articles in a generally vertical disposition, said rack comprising:

a) first and second frames, each said frame being generally rectangular, and having upper and lower horizontal members and first and second vertical supports;

b) a plurality of upper channels in generally parallel relationship to each other;

c) a plurality of lower channels in generally parallel relationship to each other and to said upper channels;

d) wherein said first frame is spaced generally parallel to said second frame, and said upper channels are attached to said upper horizontal members and said lower channels are attached to said lower horizontal members in such manner that each one of said upper channels is in alignment with a discrete one of said lower channels for forming a plurality of opposed pairs of channels, whereby each said opposed pair of channels forms a slot for receiving a planar article; and e) wherein each of said frames include a third vertical support located centrally of said first and second vertical supports; and further wherein said lower horizontal member comprises two vertically offset lower horizontal members located one on each side of said third vertical support.

* * * * *